US009950555B2

(12) United States Patent
Odaka

(10) Patent No.: US 9,950,555 B2
(45) Date of Patent: Apr. 24, 2018

(54) INK RESERVOIR MEMBER FOR WRITING INSTRUMENT, AND VALVE TYPE WRITING INSTRUMENT USING THE SAME

(71) Applicant: EPOCH CHEMICAL CO., LTD., Saitama (JP)

(72) Inventor: Haruo Odaka, Saitama (JP)

(73) Assignee: EPOCH CHEMICAL CO., LTD., Saitama (JP)

( * ) Notice: Subject to any disclaimer, the term of this patent is extended or adjusted under 35 U.S.C. 154(b) by 55 days.

(21) Appl. No.: 14/646,830

(22) PCT Filed: Oct. 7, 2014

(86) PCT No.: PCT/JP2014/076839
§ 371 (c)(1),
(2) Date: May 22, 2015

(87) PCT Pub. No.: WO2016/056067
PCT Pub. Date: Apr. 14, 2016

(65) Prior Publication Data

US 2016/0257161 A1 Sep. 8, 2016

(51) Int. Cl.
*B43K 8/04* (2006.01)
*B43K 8/02* (2006.01)
*B43K 8/03* (2006.01)

(52) U.S. Cl.
CPC ..... *B43K 8/04* (2013.01); *B43K 8/02* (2013.01); *B43K 8/03* (2013.01)

(58) Field of Classification Search
CPC . B43K 8/06; B43K 8/003; B43K 8/02; B43K 8/03; B43K 8/00; B43K 8/04; B05D 7/24
(Continued)

(56) References Cited

U.S. PATENT DOCUMENTS 6,075,070 A * 6/2000 Lin ..... B43K 5/1845 106/31.13
6,086,279 A * 7/2000 Yen ..... B43K 5/08 401/198

(Continued)

FOREIGN PATENT DOCUMENTS

EP 2474425 A1 * 7/2012 ..... B43K 8/02
JP H0650886 U 7/1995

(Continued)

*Primary Examiner* — David Walczak

(74) *Attorney, Agent, or Firm* — Browdy and Neimark, PLLC

(57) ABSTRACT

Provided is a valve type writing instrument, eliminating the need for frequently making a core pushing-in operation, thus being long-lasting, and causing no blurring of a written character. The valve type writing instrument includes an ink tank barrel; a valve housing cylinder, fitted into the ink tank barrel; and a core, slidably held in the valve housing cylinder, in which an ink reservoir member, reservoiring ink, and a valve unit case, incorporating a valve mechanism are loaded. The ink reservoir member has a truncated cone shape, a core insertion hole being formed so as to be penetrated through the central portion thereof, one half part of core being slidably housed therein, a number of slits for reservoiring ink being radially formed from the core insertion hole, and ink reservoired in the slits being capable of permeating into the housed portion of core in the core insertion hole as needed.

5 Claims, 6 Drawing Sheets

(58) Field of Classification Search
USPC ..... 401/198
See application file for complete search history.

(56) References Cited

U.S. PATENT DOCUMENTS

| | | | | |
|---|---|---|---|---|
| 6,474,893 | B1 * | 11/2002 | Osada | B43K 1/12 401/196 |
| 8,485,749 | B2 * | 7/2013 | Orem | B43K 1/12 401/198 |
| 8,944,716 | B2 * | 2/2015 | Sawa | B43K 8/003 401/202 |
| 2003/0099501 | A1 * | 5/2003 | Fukushima | B43K 7/08 401/206 |
| 2004/0067093 | A1 * | 4/2004 | Osada | B43K 8/02 401/198 |
| 2005/0095055 | A1 * | 5/2005 | Kwan | B43K 1/12 401/198 |
| 2010/0247224 | A1 * | 9/2010 | Chang | B43K 8/022 401/198 |
| 2011/0012965 | A1 * | 1/2011 | Orem | B43K 1/12 347/85 |
| 2012/0009005 | A1 * | 1/2012 | Czubarow | B43K 1/006 401/198 |
| 2012/0141189 | A1 * | 6/2012 | Sawa | B43K 8/003 401/262 |

FOREIGN PATENT DOCUMENTS

| | | | |
|---|---|---|---|
| JP | 2002-355302 | | 12/2002 |
| JP | 2002355602 | A * | 12/2002 |
| JP | 2008006668 | A | 1/2008 |
| JP | 2008087422 | A | 4/2008 |
| JP | 2008155484 | A | 7/2008 |
| JP | 2013-123843 | | 6/2013 |

* cited by examiner

INK RESERVOIR MEMBER FOR WRITING INSTRUMENT, AND VALVE TYPE WRITING INSTRUMENT USING THE SAME

BACKGROUND OF THE INVENTION

Field of the Invention

The present invention relates to an ink reservoir member for writing instrument, and a valve type writing instrument using the same, and more particularly, to an ink reservoir member for a writing instrument which, in the writing instrument, such as a direct liquid type marker equipped with a valve mechanism, can reservoir a sufficient quantity of ink and can cause the ink to permeate into a core as needed, and to a valve type writing instrument using the same.

Description of the Related Art

Writing instruments, such as markers, are divided into two broad general categories; the cotton pad type, in which a cotton pad impregnated with ink is loaded in the barrel, and the direct liquid type (raw ink type), in which the ink is directly injected into the barrel. As the conventional marker, the cotton pad type has found widespread application, however, with the cotton pad type, there are drawbacks that, once the core tip has been dried, much time is taken until the ink has permeated to a state in which writing can be resumed, and that, when writing is rapidly performed, the ink permeation speed cannot keep up with the writing speed, thereby the written characters are blurred. In contrast to this, with the direct liquid type, the core is directly contacted with the ink which is reservoired in the ink tank barrel, and thus the ink is rapidly permeated, whereby the core tip will not be dried, and even when writing is rapidly performed, the ink permeation speed can keep up with the writing speed, whereby the written characters are not blurred. Therefore, in recent years, the direct liquid type has increasingly constituted the main stream. By the way, with pigment inks, using a pigment, which is insoluble in water or alcohol, the pigment is separated from the solvent, and therefore, the ink must be stirred before use, otherwise there occurs a phenomenon that the solvent is delivered, or clogging is caused, thereby the ink being not delivered; thus the pigment ink cannot be used with the cotton pad type.

With the direct liquid type, there is the possibility that the ink may be excessively oozed out into the core, whereby a phenomenon of so-called ink dripping is caused, and therefore the valve type, in which the ink permeates into the core through a valve mechanism which is opened by pushing-in the core, has come into widespread use. However, even with the direct liquid type incorporating such a valve mechanism, there is the possibility that gripping the ink tank barrel in writing may thermally expand the air in the barrel, or the pressure inside the barrel may be raised depending upon the gripping pressure or the atmospheric pressure, whereby the ink is excessively oozed out into the core, leading to an occurrence of ink dripping. Then, conventionally, a method has been adopted which fits an absorption ring made of a foamed resin to the inner end part of the core, and absorbs the excessive ink into the absorption ring, thereby avoiding occurrence of ink dripping.

However, with the conventional mechanism which is of the valve type and further uses an absorption ring, the portion of the core where the ink is brought into contact with the core is limited to the inner end part of the core, whereby the core is easily to be dried, and thus writing blurring is easily caused. Therefore, the core must be frequently pushed in for making a valve opening operation, which is troublesome. In addition, there has been a problem that, because the operation of pushing-in the core is frequently performed, the tip end of the core is easily damaged, and thus even if a large quantity of ink remains unused, the ink becomes often impossible to be used. In addition, the existence of the above-stated absorption ring has become an obstacle for automating the assembly. In other words, because the absorption ring is made of a foamed resin, being extremely lightweight, and can be deformed with a slight force, incorporating the absorption ring mounting work in the automated line having been difficult. Therefore, a valve type writing instrument with a configuration which uses no absorption ring has been demanded.

Patent Literature 1: Japanese Unexamined Patent Application Publication No. 2008-6668

Patent Literature 2: Japanese Unexamined Patent Application Publication No. 2008-87422

Patent Literature 3: Japanese Unexamined Patent Application Publication No. 2008-155484

Patent Literature 4: Japanese Utility Model Registration No. 2594306

As described above, with the conventional mechanism which is of the valve type, and further uses an absorption ring, the core must be frequently pushed in for making a valve opening operation, which is troublesome; there is a problem that, because the operation of pushing-in the core is frequently performed, the tip end of the core is easily damaged, and thus even if a large quantity of ink remains unused, the ink becomes often impossible to be used; and incorporating the absorption ring mounting work in the automated line is difficult, thereby a valve type writing instrument with a configuration which uses no absorption ring having been demanded.

The present invention has been made to meet such a demand, and it is an object of the present invention to provide an ink reservoir member for writing instrument, and a valve type writing instrument using the same, in which a large portion of the core to be always contacted with the ink, whereby the core can be prevented from being dried, and thus which eliminate the need for frequently making a valve opening operation by pushing-in the core, being free from occurrence of early damage of the core tip that is due to frequently making a valve opening operation, and in addition, the ink being allowed to be rapidly permeated, whereby, even in performing high speed writing, blurring of a written character being not caused.

SUMMARY OF THE INVENTION

In order to achieve the above-described object, the invention in accordance with one embodiment provides an ink reservoir member, having a truncated cone-like shape, a core insertion hole being formed therein so as to be penetrated through the central portion thereof, one half part of a core being slidably housed in the core insertion hole, and a number of slits for reservoiring ink being formed radially from the core insertion hole.

In one embodiment, the bottom face of the ink reservoir member is adapted to be an inwardly directed tapered face, where an ink reservoir space, communicating to the core insertion hole and the slits, is formed. In another embodiment, the portion located behind the intermediate part of the core insertion hole is provided with a larger diameter, or is tapered, the diameter being gradually increased toward the rear end.

In order to achieve the above-described object, the invention in accordance with one embodiment provides a valve type writing instrument, including an ink tank barrel; a valve housing cylinder, being fitted into a tip end opening part of the ink tank barrel; and a core, being slidably held in the valve housing cylinder, in the valve housing cylinder, there being loaded an ink reservoir member, reservoiring ink to be impregnated into the core, and a valve unit case, incorporating a valve mechanism, the ink reservoir member having a truncated cone-like shape, a core insertion hole being formed therein so as to be penetrated through the central portion thereof, one half part of the core being slidably housed in the core insertion hole, and a number of slits for reservoiring ink being formed radially from the core insertion hole, the top face of the valve unit case being abutted against the bottom face of the ink reservoir member, and the bottom face opening thereof being closed by a cover member, having an ink passage hole for always introducing the ink in the ink tank barrel into the inside of the valve unit case, the valve mechanism being opened with the core being pushed in, delivering the ink, having been introduced into the valve unit case, to the inside of the ink reservoir member, the ink, having been delivered to the inside of the ink reservoir member, flowing in into the respective slits to be reservoired therein so as to be capable of permeating into the portion of the core that is housed in the core insertion hole, as needed.

In another embodiment, the bottom face of the ink reservoir member is configured to be an inwardly directed tapered face, thereby an ink reservoir space, communicating to the core insertion hole and the slits, being formed between the inwardly directed tapered face and the top face of the valve unit case.

In another embodiment, the portion located behind the intermediate part of the core insertion hole in the ink reservoir member is provided with a larger diameter, or is tapered, the diameter being gradually increased toward the rear end.

In another embodiment, the valve mechanism incorporated in the valve unit case is configured to include a valve element, opening and closing the top face opening, and a return spring, urging the valve element so as to always close the top face opening.

Advantages of the Invention

The ink reservoir member in accordance with the present invention provides advantages in that, because it has a truncated cone-like shape, a core insertion hole being formed therein so as to be penetrated through the central portion thereof, one half part of a core being slidably housed in the core insertion hole, and a number of slits for reservoiring ink being formed radially from the core insertion hole, a large portion of the core which is inserted into the core insertion hole can always be contacted with the ink, whereby the core can be prevented from being dried, and thus the need for frequently making a valve opening operation by pushing-in the core can be eliminated.

Further, the valve type writing instrument in accordance with the present invention provides advantages in that, because the lower half part of the core accommodated in the core holding hole directly faces, over a wide range, the core holding hole, the reservoir space, and the slits which reservoir the ink, and can always absorb the ink, the core being prevented from being dried, thus the need for frequently making a valve opening operation by pushing-in of the core being eliminated, whereby occurrence of early damage of the core tip that is due to frequently making a valve opening operation being prevented, and the ink being allowed to be rapidly permeated also in performing high speed writing, whereby blurring of a written character being not caused.

Further, there are provided economical advantages in that, even if an increase in internal pressure is caused in the ink tank barrel, the valve mechanism functions to prevent the ink from flowing into the ink reservoir cylinder, whereby ink dripping resulting from an increase in internal pressure in the ink tank barrel is avoided, and further, in the case where it is possible to dispose of the core after completion of the main body, the core can be replaced with ease, whereby, even if a damage is caused to the core, such situation can be dealt with only by replacing the core with new one.

DETAILED DESCRIPTION OF THE PREFERRED EMBODIMENT

Figure 1:
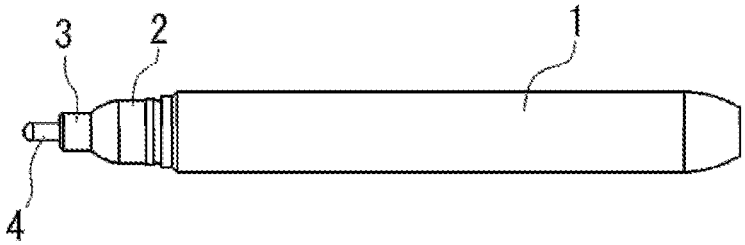
FIG. 1 is a front view of a valve type writing instrument of one embodiment in accordance with the present invention.
Figure 2:
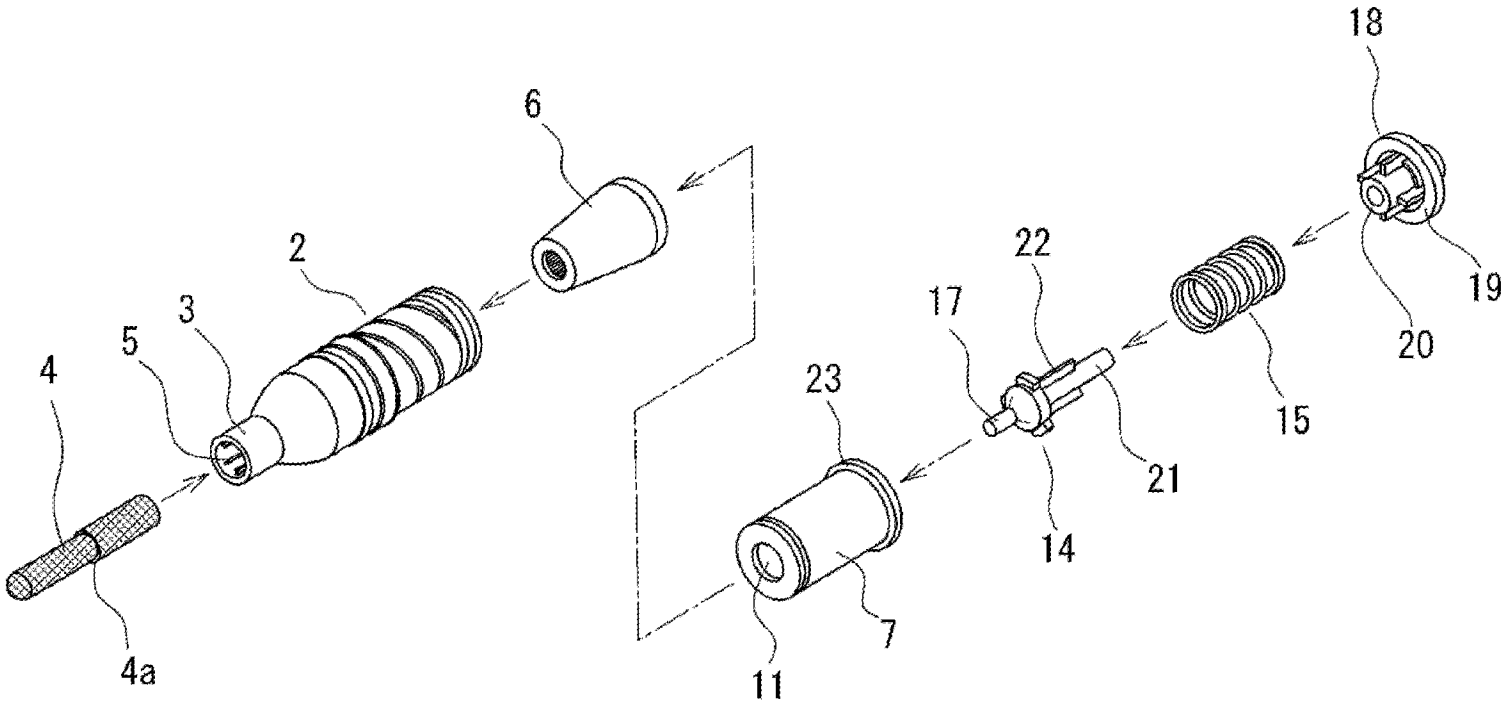
FIG. 2 is an exploded perspective view of the valve type writing instrument of one embodiment in accordance with the present invention.

Hereinbelow, an embodiment of the present invention will be explained with reference to the attached drawings. FIG. 1 is a front view of a valve type writing instrument of one embodiment in accordance with the present invention (with a cap thereof being removed) using an ink reservoir member in accordance with the present invention and FIG. 2 is an exploded perspective view thereof. As shown in these figures, the valve type writing instrument in accordance with the present invention includes an ink tank barrel 1; a valve housing cylinder 2, which is fitted into a tip end part of the ink tank barrel 1; a reduced-diameter part 3, which is integrally formed on the tip end side of the valve housing cylinder 2; a core 4, which is slidably supported by the reduced-diameter part 3, a tip end part of the core protruded from the reduced-diameter part 3; and a cap (not shown). In the following explanation, the core 4 side (the left side in these figures) is referred to as the tip end side or the top face side, while the side opposite thereto being referred to as the rear end side or the bottom face side.

On the inside face of the reduced-diameter part 3, a plurality of core holding ribs 5, the rear end parts of which extend to the inside face of the valve housing cylinder 2, are formed at equal intervals. The core 4 is slidably supported by the reduced-diameter part 3, the peripheral surface of the core 4 being surrounded by this core holding ribs 5. Each of the core holding ribs 5 is formed as a strip which protrudes from the inside face of the reduced-diameter part 3 to such an extent that it is lightly contacted with the core 4 for the purpose of holding the core 4 in a slidable manner. As described later, the core 4 can be adapted so as to be loaded after completion of the main body of the present valve type writing instrument.

Figure 6:
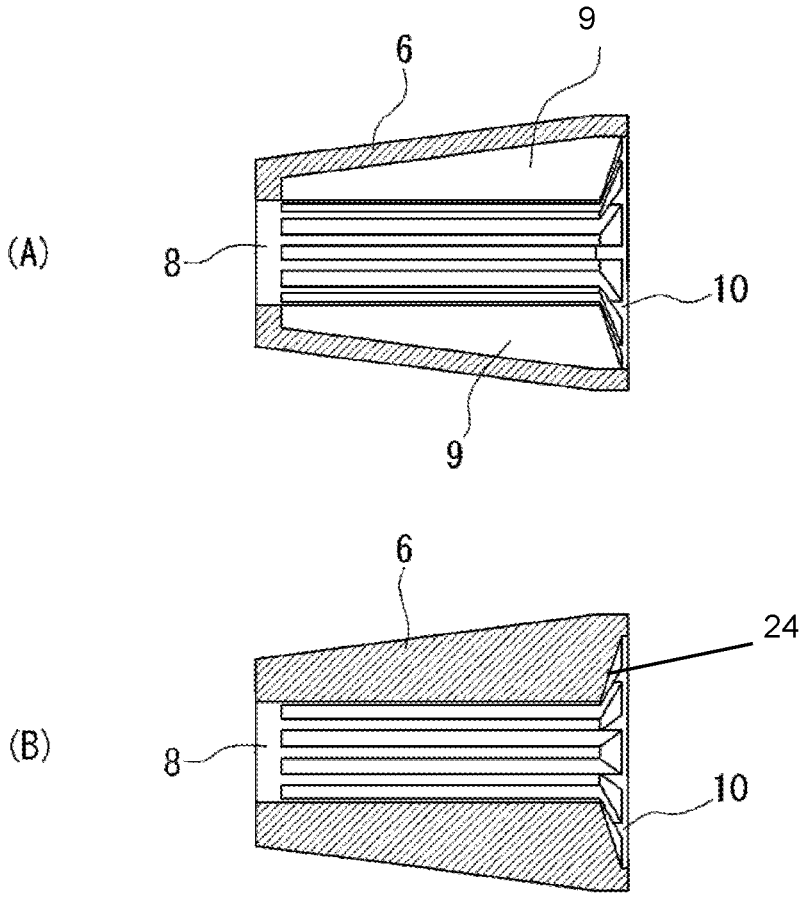
FIGS. 6(A) and 6(B) are longitudinal sectional views illustrating an example of geometry of an ink reservoir member in the valve type writing instrument in accordance with the present invention (FIGS. 6(A) and 6(B) being sectional view along the line B-B and the line C-C in FIG. 5, respectively, excluding the valve housing cylinder)
Figure 7:
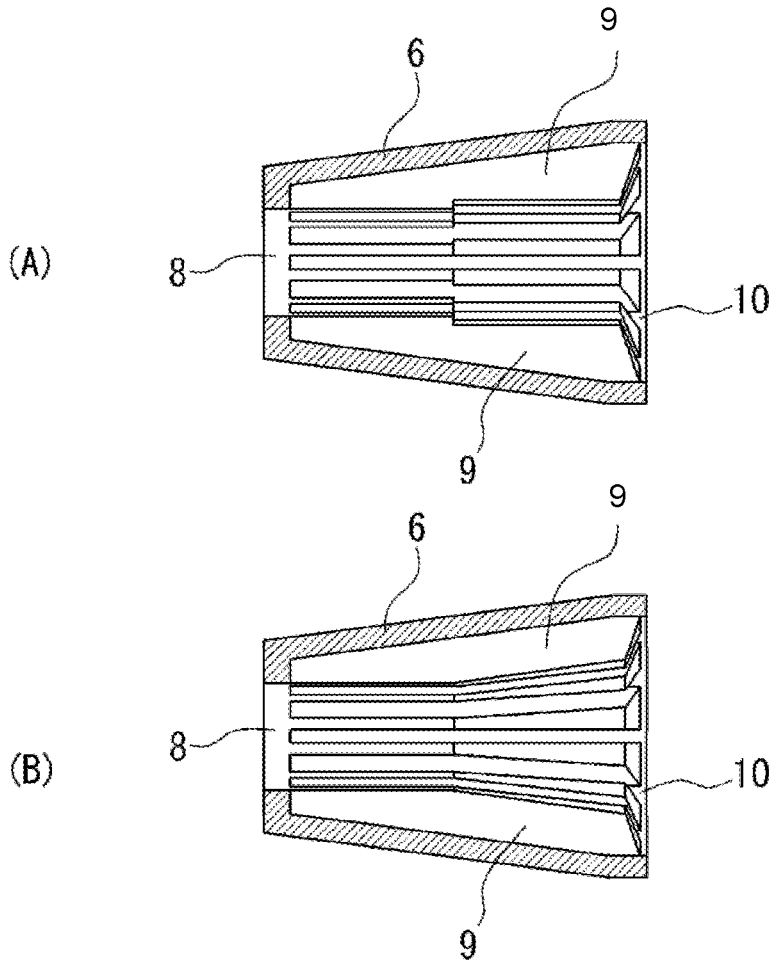
FIGS. 7(A) and 7(B) are longitudinal sectional views illustrating another example of geometry of the ink reservoir member in the valve typewriting instrument in accordance with the present invention.

In the valve housing cylinder 2, there are loaded an ink reservoir member 6, which reservoirs the ink to be impregnated into the core 4, and a valve unit case 7, which is disposed on the rear side of the ink reservoir member 6, incorporating a valve mechanism. The ink reservoir member 6 has a truncated cone-like shape, and a core insertion hole 8 is formed so as to be penetrated through the central portion thereof (especially see FIGS. 6(A) and 6(B), and FIGS. 7 (A) and 7 (B)). Into this core insertion hole 8, one half part of the core 4 is slidably inserted (see FIGS. 3 and 4). Generally, the core insertion hole 8 is provided with the same diameter over the entire length thereof, however, the portion located behind the intermediate part may be provided with a slightly larger diameter (FIG. 7 (A)), or may be tapered (FIG. 7 (B)). Further, radially from the core insertion hole 8, a number of slits 9 for reservoiring the ink are formed.

Further, in a preferred embodiment, the bottom face of the ink reservoir member 6 is provided as a tapered face 24 which is inwardly concaved toward the core insertion hole 8, such that, between the tapered face 24 and the top face of the valve unit case 7, an ink reservoir space 10 for reservoiring the ink is formed.

Figure 3:
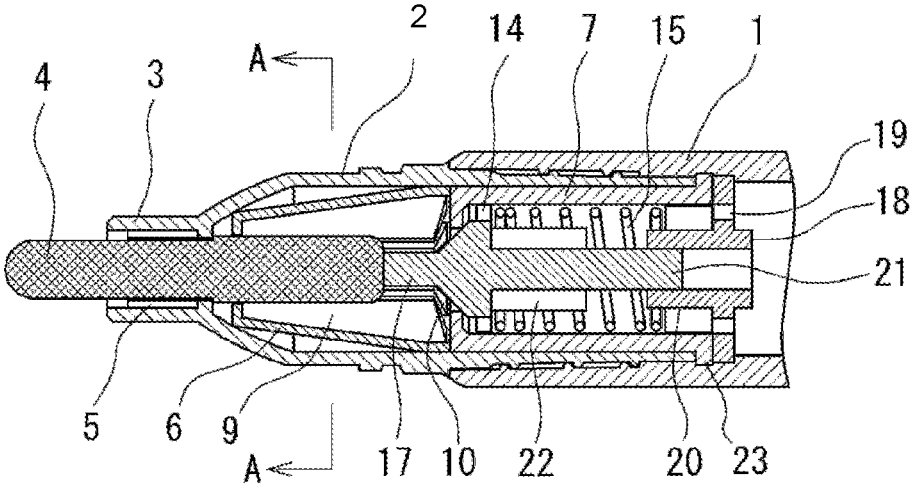
FIG. 3 is an enlarged sectional view of the critical part (at the time of normal use) of the valve typewriting instrument of one embodiment in accordance with the present invention.
Figure 4:
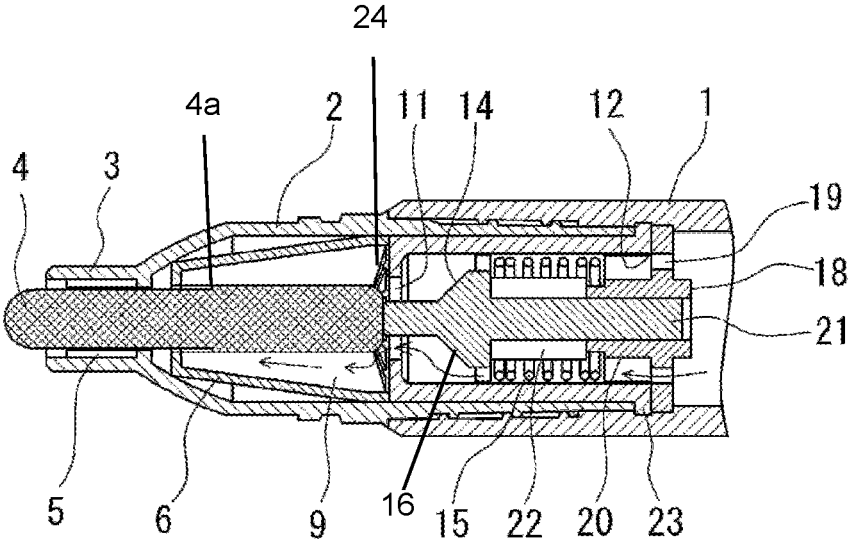
FIG. 4 is an enlarged sectional view of the critical part (at the time of core pushing-in) of the valve type writing instrument of one embodiment in accordance with the present invention.
Figure 5:
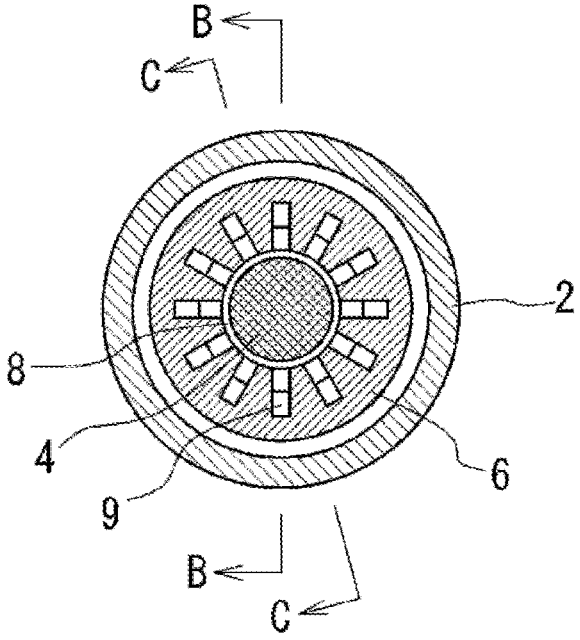
FIG. 5 is an enlarged sectional view taken along the line A-A in FIG. 3.

The valve unit case 7 has a top face opening 11 and a bottom face opening 12, and in the valve unit case 7, there are incorporated a valve element 14, which opens and closes the top face opening 11, and a return spring 15, which urges the valve element 14 so as to normally close the top face opening 11 (see FIGS. 3 and 4). The valve element 14 is shaped like a spinning top, having a tapered face 16, which provides a valve seat abutting part, and a top face side shaft 17, which is protruded from the tapered face 16, is projected from the top face opening 11 to face the inside of the core insertion hole 8 at the time of assembling.

The valve element 14 is always pushed up by the return spring 15, so that at the time of no-load, the tapered face 16 is abutted against the inner edge of the top face opening 11, which serves as a valve seat, to thereby close the top face opening 11 (see FIG. 3). When the core 4 is pushed in against the pushing-up force of the return spring 15, whereby the valve element 14 is pressed by the core 4, the tapered face 16 of the valve element 14 is separated from the inner edge of the top face opening 11, i.e., the valve seat, whereby the top face opening 11 is opened (see FIG. 4). With the top face opening 11 being thus opened, the ink, which has been stored in the valve unit case 7, flows out into the reservoir space 10 through the top face opening 11, and therefrom, flows into the respective slits 9 to fill them.

The bottom face opening 12 of the valve unit case 7 is closed by a cover member 18, which has an ink passage hole 19 defined therein for always introducing the ink in the ink tank barrel 1 into the inside of the valve unit case 7 (see FIGS. 3 and 4). Generally, a plurality of ink passage holes 19 are provided so as to surround a supporting cylinder 20, which is formed in the central portion of the cover member 18. The return spring 15 is supported with the upper end face thereof being abutted against a face on the rear side of the tapered face 16 of the valve element 14, and the lower end face being abutted against the cover member 18. Further, the bottom face-side shaft 21 of the valve element 14 is slidably inserted into the supporting cylinder 20 of the cover member 18.

Further, along the bottom face-side shaft 21 of the valve element 14, a plate-like stopper 22 is formed so as to be accommodated in the return spring 15. This plate-like stopper 22 is abutted against the cover member 18 (the top face of the supporting cylinder 20) when the core 4 being pushed in, thereby serving to regulate the pushing-in position of the core 4 (see FIGS. 2, 3, and 4).

The bottom face part of the valve unit case 7 is extended outward to form a flange 23, and the valve unit case 7 is inserted into the valve housing cylinder 2 until the flange 23 thereof is abutted against the lower end face of the valve housing cylinder 2, which, at the time of assembly, faces the inside of the ink tank barrel 1, whereby the position of insertion thereof into the valve housing cylinder 2 is defined. And, in that position, the top face of the valve unit case 7 is abutted against the bottom face of the ink reservoir member 6, with the top face opening 11 thereof communicating with the core holding hole 8 (the ink reservoir space 10) (see FIGS. 3 and 4).

With the configuration as described above, the ink which is delivered from the valve unit case 7 with the top face opening 11 of the valve unit case 7 being opened flows into the respective slits 9 through the ink reservoir space 10, filling the ink reservoir space 10 and the respective slits 9. Then, the ink, which has filled the ink reservoir space 10 and the respective slits 9, directly permeates into the core 4, the lower half part thereof having been inserted into the ink reservoir member 6 to face the ink reservoir space 10 and the slits 9 over a wide range. At that time, the surplus ink is reservoired in the reservoir space 10 and the respective slits 9, and, as the ink impregnated in the core 4 is reduced with the writing, permeates into the core 4 as needed.

Further, by directing the core 4 downward, the ink in the ink tank barrel 1 freely passes through the ink passage hole 19 in the cover member 18 by its own weight, flowing into the valve unit case 7 to fill it. The ink, which has been introduced into the valve unit case 7, is kept reservoired there until the core 4 is pushed into the valve housing cylinder 2, and the top face opening 11 is opened. Then, as described above, simultaneously with the core 4 being pushed into the valve housing cylinder 2 to open the top face opening 11, the ink flows into the ink reservoir member 6 (FIG. 4) to fill the ink reservoir space 10 and the respective slits 9.

Thus, with the writing instrument in accordance with the present invention, the lower half part of the core 4 is accommodated in the core holding hole 8, which is surrounded by the ink reservoir space 10 and the respective slits 9, always reservoiring the ink, and can absorb the ink as needed, whereby the core 4 is prevented from being dried. Therefore, the need for frequently making a valve opening operation by pushing-in the core 4 is eliminated to thereby prevent occurrence of early damage of the core tip that is due to frequently making a valve opening operation. In addition, even if writing is performed at high speed, the ink rapidly permeates, thereby blurring of a written character being difficult to be caused.

Further, the valve type writing instrument in accordance with the present invention provides a feature that it can be completed by taking the procedure constituted by loading the valve element 14 and the return spring 15 in the valve unit case 7; covering the valve unit case 7 with the cover member 18 to complete the valve mechanism part; housing this in the valve housing cylinder 2 together with the ink reservoir member 6; thereafter, inserting the core 4 from the reduced-diameter part 3 of the valve housing cylinder 2; and finally fitting the valve housing cylinder 2 in the ink tank barrel 1. In addition, there is an advantage that the core 4 can also be finally inserted to be installed, and can be replaced with new one at any time.

Contrarily to this, there may be provided a configuration in which the core 4 is difficult to be removed from the pen tip portion. In order to implement such configuration, a stepped part 4*a* can be provided for the core 4 so as to be locked at the reduced-diameter part 3 of the valve housing cylinder 2 (see FIGS. 2 and 4).

Hereinabove, the present invention has been explained in detail to some extent, and about the most preferred embodiment, however, since it is obvious that a wide range of different embodiments can be made without departing from the spirit and scope of the present invention, it is to be understood that the present invention is not limited to the specific embodiments thereof as defined in the appended claims.

What is claimed is:

1. A valve type writing instrument, comprising:

an ink tank barrel;

a valve housing cylinder, being fitted into a tip end opening part of said ink tank barrel;

a core, being slidably held in said valve housing cylinder, an ink reservoir member disposed in the valve housing cylinder, the ink reservoir member configured to reservoir ink to be impregnated into said core; and a valve unit case, incorporating a valve mechanism, disposed in the valve housing cylinder, wherein said ink reservoir member has a truncated cone-like shape, and comprises a core insertion hole defined through a central portion of the ink reservoir member, a portion of said core being slidably housed in the core insertion hole, and a number of slits configured and disposed to hold ink and defined in the ink reservoir member radially from the core insertion hole and extending along a longitudinal direction of the ink reservoir member, wherein a top face of said valve unit case is abutted against a bottom face of said ink reservoir member, and a cover member is configured to close an opening in the bottom face of the valve unit case, and the cover member has an ink passage hole defined therein for introducing the ink in said ink tank barrel into an inside of said valve unit case, wherein said valve mechanism is opened with said core being pushed in, delivering the ink, having been introduced into said valve unit case, to an inside of said ink reservoir member, and wherein the ink, having been delivered to the inside of said ink reservoir member, flowing into said respective slits to be reservoired therein to permeate into the portion of said core that is slidably housed in said core insertion hole, as needed.

2. The valve type writing instrument according to claim 1, wherein the bottom face of said ink reservoir member is an inwardly directed tapered face, and an ink reservoir space, communicating to said core insertion hole and said slits, is defined between the inwardly directed tapered face and the top face of said valve unit case.

3. The valve type writing instrument according to claim 1, wherein a rear portion of the ink reservoir member located behind an intermediate part of said core insertion hole in said ink reservoir member is provided with a larger diameter, or is tapered such that a diameter of the core insertion hole at the rear portion gradually increases toward a rear end of the ink reservoir member.

4. The valve type writing instrument according to claim 1, wherein said valve mechanism incorporated in said valve unit case includes a valve element, opening and closing the top face opening, and a return spring, biasing said valve element so as to close said top face opening.

5. The ink reservoir member according to claim 1, wherein the core is maintained in contact with the ink reservoired in the ink reservoir member.

* * * * *